US008463163B2

(12) United States Patent
Goto

(10) Patent No.: US 8,463,163 B2
(45) Date of Patent: Jun. 11, 2013

(54) DEVELOPING DEVICE AND IMAGE FORMING APPARATUS HAVING THE SAME

(75) Inventor: Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 289 days.

(21) Appl. No.: 12/957,828

(22) Filed: Dec. 1, 2010

(65) Prior Publication Data

US 2011/0135343 A1 Jun. 9, 2011

(30) Foreign Application Priority Data

Dec. 9, 2009 (JP) ..... 2009-279407

(51) Int. Cl.
*G03G 15/08* (2006.01)

(52) U.S. Cl.
USPC ..... 399/254; 399/263

(58) Field of Classification Search
USPC ..... 399/254, 256, 263
See application file for complete search history.

(56) References Cited

U.S. PATENT DOCUMENTS

| | | | | |
|---|---|---|---|---|
| 6,459,876 | B1 * | 10/2002 | Buchanan et al. | 399/254 |
| 2005/0123324 | A1 | 6/2005 | Kawano et al. | |
| 2007/0140743 | A1 * | 6/2007 | Kamimura | 399/254 |

FOREIGN PATENT DOCUMENTS

| | | | |
|---|---|---|---|
| EP | 1538489 | A1 | 6/2005 |
| JP | 2005-172842 | A | 6/2005 |

* cited by examiner

*Primary Examiner* — Walter L Lindsay, Jr.
*Assistant Examiner* — Barnabas Fekete
(74) *Attorney, Agent, or Firm* — Marvin A. Motsenbocker; Mots Law, PLLC

(57) ABSTRACT

A developing device includes: a developer carrier configured to form a developer image on an image carrier by developing an electrostatic latent image on the image carrier; a developer supplier being in contact with the developer carrier and configured to supply a developer to an outer circumferential surface of the developer carrier; and an agitating member configured to agitate the developer around the developer carrier or the developer supplier, wherein a tip of the agitating member, upon a rotation of the agitating member, moves in a noncircular path.

19 Claims, 8 Drawing Sheets

| PRINTING SPEED | 100 mm/s | | 150 mm/s | | 200 mm/s | |
|---|---|---|---|---|---|---|
| NUMBER OF COPIES | CIRCULAR PATH | FIRST EMBODIMENT | CIRCULAR PATH | FIRST EMBODIMENT | CIRCULAR PATH | FIRST EMBODIMENT |
| 0 | ✓ | ✓ | ✓ | ✓ | ✓ | ✓ |
| 2,500 | ✓ | ✓ | ✓ | ✓ | ✓ | ✓ |
| 5,000 | ✓ | ✓ | ✓ | ✓ | — | ✓ |
| 7,500 | ✓ | ✓ | ✓ | ✓ | — | ✓ |
| 10,000 | ✓ | ✓ | — | ✓ | — | ✓ |
| 12,500 | ✓ | ✓ | — | ✓ | — | ✓ |
| 15,000 | ✓ | ✓ | — | ✓ | — | ✓ |

✓: NO FADING OCCURRED —: FADING OCCURRED

| PRINTING SPEED | 100 mm/s | | 150 mm/s | | 200 mm/s | |
|---|---|---|---|---|---|---|
| NUMBER OF COPIES | CIRCULAR PATH | SECOND EMBODIMENT | CIRCULAR PATH | SECOND EMBODIMENT | CIRCULAR PATH | SECOND EMBODIMENT |
| 0 | ✓ | ✓ | ✓ | ✓ | ✓ | ✓ |
| 2,500 | ✓ | ✓ | ✓ | ✓ | ✓ | ✓ |
| 5,000 | ✓ | ✓ | ✓ | ✓ | — | ✓ |
| 7,500 | ✓ | ✓ | ✓ | ✓ | — | ✓ |
| 10,000 | ✓ | ✓ | — | ✓ | — | ✓ |
| 12,500 | ✓ | ✓ | — | ✓ | — | ✓ |
| 15,000 | ✓ | ✓ | — | ✓ | — | ✓ |

✓: NO FADING OCCURRED —: FADING OCCURRED

DEVELOPING DEVICE AND IMAGE FORMING APPARATUS HAVING THE SAME

CROSS REFERENCE TO RELATED APPLICATIONS

This application claims priority based on 35 USC 119 from prior Japanese Patent Application No. P2009-279407 filed on Dec. 9, 2009, entitled "DEVELOPING DEVICE AND IMAGE FORMING APPARATUS HAVING THE SAME", the entire contents of which are incorporated herein by reference.

BACKGROUND OF THE INVENTION

1. Field of the Invention

The invention relates to a developing device including a developing roller configured to develop an electrostatic latent image on a photosensitive drum to form a toner image on the photosensitive drum, and an image forming apparatus including the developing device.

2. Description of Related Art

In an electrophotographic printer, the method for forming an image includes the steps of charging, exposing light, developing, transferring, fixing, and cleaning.

In the developing process among those processes, a contact-type developing device using a single component non-magnetic toner is often used in view of downsizing and cost reduction. In the contact-type developing device, a developing roller is in contact with a photosensitive drum and voltage is applied to the developing roller, so that the toner is supplied from the developing roller to the photosensitive drum thereby developing the electrostatic latent image on the photosensitive drum.

Such a conventional developing device includes a development blade being in press-contact with the developing roller and thus forming a thin layer of the toner on the developing roller, a feed roller made of a foam member configured to feed the toner to the developing roller, an agitating member provided above a nip (a contact) between the developing roller and feed roller, and a toner supplier provided in the area above the feed roller and configured to supply the toner by intermittently contacting with the feed roller. The agitating member rotates in the same direction as the rotations of the developing roller and the feed roller while moving in a circular path and the toner supplier rotates in the opposite direction while moving in a circular path at a position opposed to the upper face of the feed roller. This configuration prevents clumped toner, in the vicinity of the feed roller, which is caused by contact and friction between the developing roller and feed roller or by the weight of the toner and which may causes less flowability of the toner, so as to prevent occurrence of fading in a printed image on a sheet (for example, see Japanese Patent Application Laid-Open No. 2005-172842, particularly see paragraphs 9035-0046 and FIG. 1).

SUMMARY OF THE INVENTION

In the above conventional technique, however, since the tip of the agitating member and the tip of the toner supplier respectively move in circular paths as they rotate to agitate the toner, it is difficult to sufficiently agitate the toner in a narrow area AR (see FIG. 2) which is the space between the development blade and developing roller and above the nip between the feed roller and developing roller. Therefore, deterioration of image quality such as a fading may occur during high-speed continuous printing using an image forming apparatus due to the clumped toner in the area AR.

An object of an aspect of the invention is to improve image quality by preventing fading or the like during high-speed continuous printing or the like.

A first aspect of the invention is a developing device including: a developer carrier configured to form a developer image on an image carrier by developing an electrostatic latent image on the image carrier; a developer supplier configured to supply developer to an outer circumferential surface of the developer carrier while being in contact with the outer circumferential surface of the developer carrier and; a developer layer regulating member configured to form a layer of the developer on the outer circumferential surface of the developer carrier; an agitating member configured to agitate the developer in the vicinity of the developer carrier or the developer supplier; and a case having a support portion configured to rotatably support the developer carrier, the developer supplier, and the agitating member, wherein a rotation path of the tip of the agitating member upon rotation of the agitating member is noncircular.

A second aspect of the invention is an image forming apparatus including the developing device according to the first aspect.

A third aspect of the invention is a developing device used for supplying a developer, including: a first roller being rotatable; a second roller being rotatable while being in contact with the first roller; an agitating member including a rotational shaft and configured to rotate about the rotational shaft to agitate the developer in the vicinity of the contact between the first roller and second roller, wherein a rotation path of a tip of the agitating member upon the rotation of the agitating member is noncircular.

A fourth aspect of the invention is a developing device used for supplying a developer, including a first roller being rotatable; a second roller being rotatable while being in contact with the first roller; an agitating member and configured to rotate about a rotational axis to agitate the developer in the vicinity of the contact between the first roller and second roller; a guide mechanism configured to guide the movement of the agitating member upon the rotation of the agitating member such that the tip of the agitating member moves in a noncircular path.

According to the aspects, the agitating member can agitates a wide area including a narrow area defined near the developer carrier or the developer supplier and thus prevents occurrence of fading during continuous printing, thereby providing preferable image quality over a long period of time.

DETAILED DESCRIPTION OF EMBODIMENTS

Figure 1:
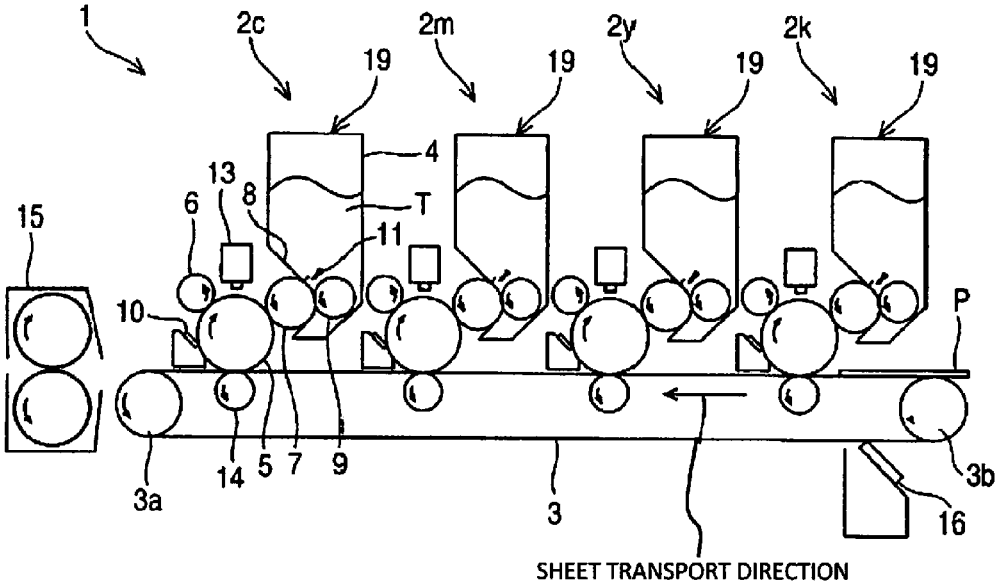
FIG. 1 is a side view of an image forming device according to a first embodiment.

Descriptions are provided herein-below for embodiments based on the drawings. In the respective drawings referenced herein, the same constituents are designated by the same reference numerals and duplicate explanation concerning the same constituents is omitted. All of the drawings are provided to illustrate the respective examples only.

Developing devices according to embodiments of the invention will be described with reference to the drawings.

[First Embodiment]

In FIG. 1, the reference numeral 1 represents an image forming device, as a printer engine, mounted in an electrophotographic color printer as an image forming apparatus.

The reference numeral 2 (2*c* to 2*k*) represents a developer image forming unit which is detachably mounted to the body of electrophotographic color printer 1. Developer image forming unit 2 is opposed to transfer belt 3 (or an endless belt) that extends between driving roller 3*a* and tension roller 3*b* such that sheet P as a medium that is transported on transfer belt 3 passes between developer image forming unit 2 and transfer belt 3.

Image forming device 1 includes four developer image forming units 2*k*, 2*y*, 2*m*, 2*c* respectively including toner cartridge 4 as developer cartridge respectively containing toner T as a developer of color K (black), color Y (yellow), color M (magenta) or color C (cyan). Developer image forming units 2*k*, 2*y*, 2*m*, 2*c* are disposed in order along the transport direction of sheet P (hereinafter, referred to as a sheet transport direction) in the order that toner images as developer images are developed. Each developer image forming unit 2 (2*k*, 2*y*, 2*m*, 2*c*) includes photosensitive drum 5 and charging roller 6, developing roller 7, development blade 8, feed roller 9, cleaning blade 10 and agitating member 11, which are disposed around photosensitive drum 5. Those elements are electrically connected to corresponding power supply units when developer image forming unit 2 is mounted to image forming device 1.

In each developer image forming unit 2, exposure head 13 as an exposure device is disposed above and opposed to photosensitive drum 5. Transfer rollers 14 are disposed beneath photosensitive drum 5 and inside the loop of transfer belt 3 (endless belt) having two linear sections such that one liner section of transfer belt 3 on the side of photosensitive drum 5 is sandwiched between photosensitive drum 5 and transfer roller 14. Provided downstream of the sheet transport direction of transfer belt 3 is fixing device 15 configured to fix the toner image by melting toner T using heat and pressure and penetrating toner T into the fibers of sheet P. Near tension roller 3*b* of transfer belt 3 and at the opposite side from photosensitive drum 5, there is provided belt cleaning blade 16 for removing toner T remaining on transfer belt 3.

Toner T of this embodiment is a ground toner and includes polyester as a binder resin, carbon black for the color black, isoindoline-type pigment for yellow, copper phthalocyanine-type pigment for cyan, and quinacridone-type pigment for magenta. Further, the volume average particle diameter is 5.8 μm and an additive is added for the purpose of controlling fluidity and polarity.

This additive may be titanium oxide, alumina, silica and the like. Silica may be processed with silicone oil or disilazane for example. Further, the primary particle sizes of the additive may be 7 nm, 12 nm, 14 nm, 21 nm, 40 nm or the like and a combination of those particles is added as an additive and mixed with the base toner by a Turbula mixer or Henshell mixer.

Exposure head 13 serving as an exposing device has a light emitting element such as an LED (Light Emitting Diode) or a laser and is configured to form an electrostatic latent image by irradiating light corresponding to an image signal onto a surface of photosensitive drum 5.

Photosensitive drum 5 serving as an image carrier is a cylindrical tubular member formed by covering the outer peripheral surface of a metal pipe, which is serving as a conductive support member, with an organic photoreceptor. The length of photosensitive drum 5 in the axial direction, a direction orthogonal to the sheet transport direction, is longer than the maximum width of all types of paper sheets P used in the device. Photosensitive drum 5 is driven to rotate in the direction of transporting sheet P (the clockwise direction indicated by the arrow in FIG. 1, and referred to as the transporting rotation direction) by an unillustrated drive source such as a drive motor.

Charging roller 6 as a charging member is formed by covering a metal rotation shaft with a semiconductor rubber layer with both axial end portions of the metal rotation shaft being exposed, and thus charging roller 6 is a cylindrical column member with a smaller diameter portion at each axial end portions. Charging roller 6 has substantially the same length as the photosensitive drum 5 in the axial direction. Charging roller 6 is driven to rotate corresponding to the rotation of photosensitive drum 5 while contacting with photosensitive drum 5, thereby uniformly charging photosensitive drum 5.

Figure 2:
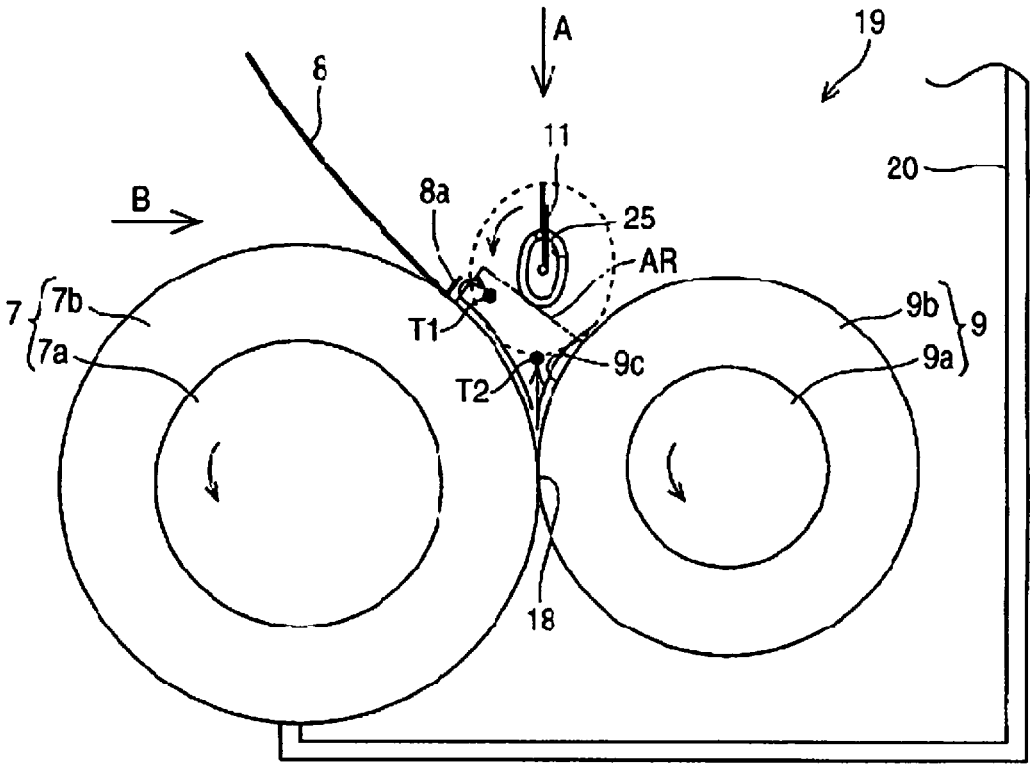
FIG. 2 is a side view of a developing device according to the first embodiment.

Developing roller 7 serving as a developer carrier is formed by covering an outer peripheral surface of metal rotation shaft 7*a* with elastic member 7*b* with each axial end portion of the metal rotation shaft 7*a* being exposed, and thus developing roller 7 is a cylindrical column member having a smaller diameter portion at each axial end portion (see FIG. 2). Developing roller 7 has substantially the same length as photosensitive drum 5 in the axial direction. Developing roller 7 is driven to rotate in an opposite direction while contacting photosensitive drum 5 to form a toner image by developing the electrostatic latent image which is formed on photosensitive drum 5 by exposure head 13.

Developing roller 7 of this embodiment is formed by covering an outer peripheral surface of metal rotation shaft 7*a* having a diameter of 12 mm with elastic member 7*b* made of semiconducting urethane rubber having a thickness of 4 mm and a rubber hardness of 70 degrees (ASKER Type C) and the surface layer is processed to adjust the friction coefficient, roughness, and charging characteristics.

Feed roller 9 serving as a developer supplier is formed by covering metal rotation shaft 9*a* with foam member 9*b* while each axial ends of metal rotation shaft 9*a* is not covered with foam member 9*b*, and thus feed roller 9 is a cylindrical column member having a smaller diameter portion at each axial end portion (see FIG. 2). Feed roller 9 has substantially the same length as developing roller 7 in the axial direction. Feed roller 9 is pressed against developing roller 7 and rotates in the same direction as the rotation of developing roller 7. Feed roller 9 has the function to charge toner T supplied from toner cartridge 4 and to feed toner T to developing roller 7.

Feed roller 9 of this embodiment is formed by covering the outer peripheral surface of metal rotation shaft 9*a* having a diameter of 6 mm with urethane foam member, as foam member 9*b*, having a thickness of 5 mm and a hardness of 50 degrees (ASKER Type F).

Development blade 8 serving as a developer layer regulating member is a flexible, thin metal, L-shaped plate, such as a stainless steel plate, having bent part 8*a* at its tip portion. The length of development blade 8 in a longitudinal direction is substantially the same as the length of developing roller 7 in the axial direction. The tip portion of development blade 8 is in contact with developing roller 7, at a downstream point of nip 18 (the contact) between developing roller 7 and feed roller 9 in the rotational direction of developing roller 7, such that bent part 8*a* of the tip portion faces feed roller 9 (see FIG. 2) and the other side of the tip portion, which is a surface of the tip portion opposite to bent part 8*a*, slidingly contacting with the outer circumferential surface of developing roller 7 at a predetermined contact pressure. Development blade 8 has a function to form a toner layer, serving as a developer layer, having a predetermined thickness on developing roller 7

Development blade 8 of this embodiment is made by bending a stainless steel plate having a thickness of 0.08 mm (SUS304) into an L shape.

Cleaning blade 10, serving as a developer remover, is a rubbery elastic plate member. The length of cleaning blade 10 in a longitudinal direction is substantially the same as the length of photosensitive drum 5 in the axial direction. Cleaning blade 10 is disposed downstream of a contact point between photosensitive drum 5 and developing roller 7 in the transporting rotation direction such that the edge of cleaning blade 10 is in contact with the outer circumferential surface of photosensitive drum 5 at a predetermined pressure. Cleaning blade 10 is thus in slide-contact with the outer circumferential surface of photosensitive drum 5 as photosensitive drum 5 rotates, to remove toner T remaining on the outer circumferential surface of photosensitive drum 5 after the toner image is transferred from photosensitive drum 5

The length of transfer roller 14, serving as a developer image transfer device, in the axial direction is substantially the same as the length of photosensitive drum 5 in the axial direction. Transfer roller 14 is disposed to contact with the inside surface of the linear section of transfer belt 3, which adjacent to photosensitive drum 5. Transfer roller 14 is driven by a drive source (not shown) to rotate independently from photosensitive drum 5 and has a function to transfer the toner image from the surface of the photosensitive drum 5 to sheet P, using voltage applied to transfer roller 14.

In developing device 19 of this embodiment, developing roller 7, development blade 8, feed roller 9 and agitating member 11 are provided in case 20. Toner T supplied from toner cartridge 4 is fed to the vicinity of developing roller 7 and feed roller 9 in case 20.

Agitating member 11 of this embodiment has first agitating plate 21 and second agitating plate 22 which are formed of a rectangular-shaped stainless steel plate (SUS304) having a thickness of 0.08 mm. Agitating member 11 rotates to agitate toner T in narrow recess or inaccessible area AR between feed roller 9 and developing roller 7, so as to break up clumped toner T.

As illustrated by the two-dot dashed line in FIG. 2, area AR is an area between feed roller 9 and developing roller 7 and above nip 18. That is, area AR is a trapezoid-shaped area defined by bent part 8*a* of development blade 8, a part (referred to as opposite part 9*c*) of the outer circumference of feed roller 9, which is opposed to bent part 8*a*, and a part of the outer circumference of developing roller 7 between nip 18 and bent part 8*a*.

As shown in FIG. 2, mechanically-compacted toner T including toner T1 that was scraped from developing roller 7 by development blade 8 without passing through development blade 8 and toner T2 that pressed in nip 18 between developing roller 7 and feed roller 9 may flow into and stay in area AR above nip 18. Such damaged toner T may cause image quality deterioration such as a fading or the like.

In the case where a conventional agitating member having a single agitating plate is used, it is required to place the rotation center (axis) of the agitating plate at a place where the circular path of the tip of the agitating plate does not interfere with developing roller 7, development blade 8 and feed roller 9. This makes it difficult to sufficiently agitate toner T in area AR above nip 18.

Further, if the rotation radius of the agitating member is made smaller and the rotation center (axis) is placed in area AR, toner T in area AR can be agitated; however, this makes it difficult to sufficiently mix toner T in other areas and mechanically-compacted toner T may constantly remain in area AR.

Agitating member 11 of this embodiment has a combination of first and second agitating plates 21, 22 such that the rotation path of the tip of agitating member 11 upon rotation of agitating member 11 is an elliptic (noncircular) path, as indicated by the dotted line in FIG. 2. In order to achieve a wide agitation area (the area in the elliptic path indicated by the dotted line) including area AR, agitating member 11 is made in the following configuration.

Note that the noncircular path is close to but not contacting with developing roller 7, development blade 8 and feed roller 9, respectively. Thus, the long axis of the elliptic path of the tip of the agitating member 11 in this embodiment extends toward nip 18 between feed roller 9 and developing roller 7.

First agitating plate 21 is a plate-shaped member whose longitudinal length is equal to or shorter than the lengths of developing roller 7 and feed roller 9 in the axial direction. One end of first agitating plate 21 in the widthwise direction orthogonal to the longitudinal direction is eccentrically attached to rotation shaft 21*a* (see FIGS. 4 and 6). First agitating plate 21 is driven to rotate about rotation shaft 21*a* in the direction same as the rotation of developing roller 7 and feed roller 9.

Second agitating plate 22 is a plate-shaped member whose longitudinal length is equal to or shorter than the longitudinal length of first agitating plate 21. One end of second agitating plate 22 in the widthwise direction is eccentrically attached to guide shaft 22*a* (see FIGS. 3 and 6) and the other widthwise end of second agitating plate 22 (the tip of the second agitating plate 22), which is on the opposite side of guide shaft 22*a*, projects from the tip of first agitating plate 21.

Figure 3:
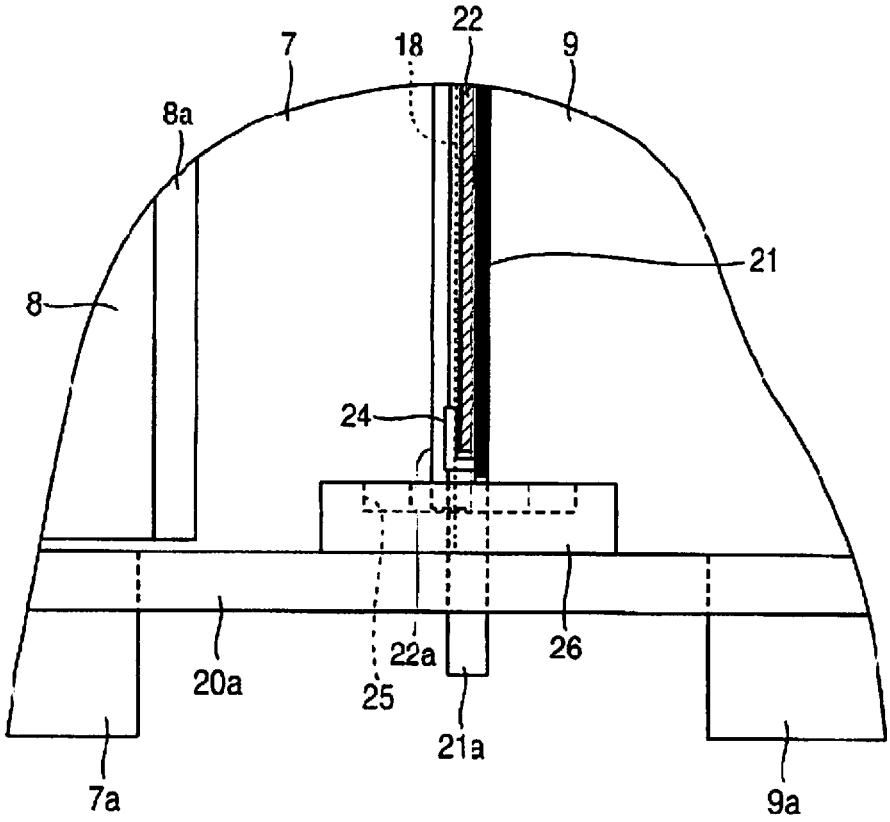
FIG. 3 is an enlarged view of an agitating member seen from the direction A in FIG. 2.
Figures 6, 7:
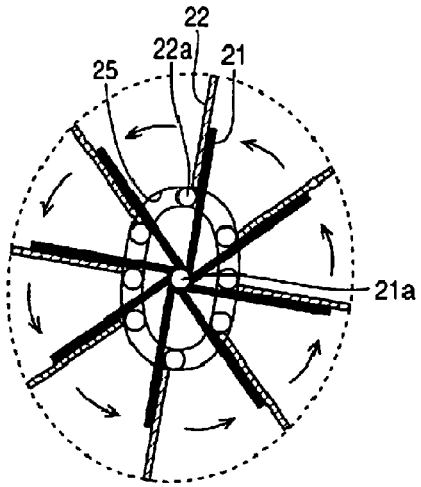
FIG. 6 illustrates positions where the agitating member moves.
FIG. 7 illustrates test results of a continuous printing test of the developing device according to the first embodiment.

Note that, in order to distinguish first agitating plate 21 from second agitating plate 22, in FIGS. 3 and 6, first agitating plate 21 is illustrated in solid black and second agitating plate 22 is illustrated by hatching.

Figure 4:
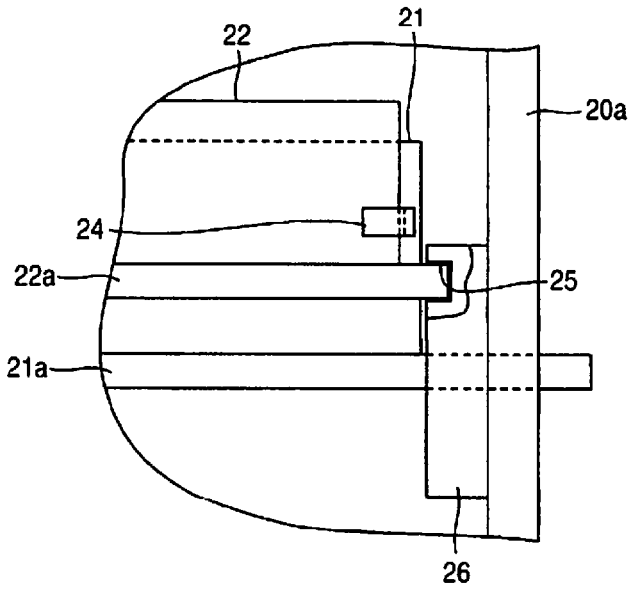
FIG. 4 is an enlarged view of the agitating member seen from the direction B in FIG. 2.
Figure 5:
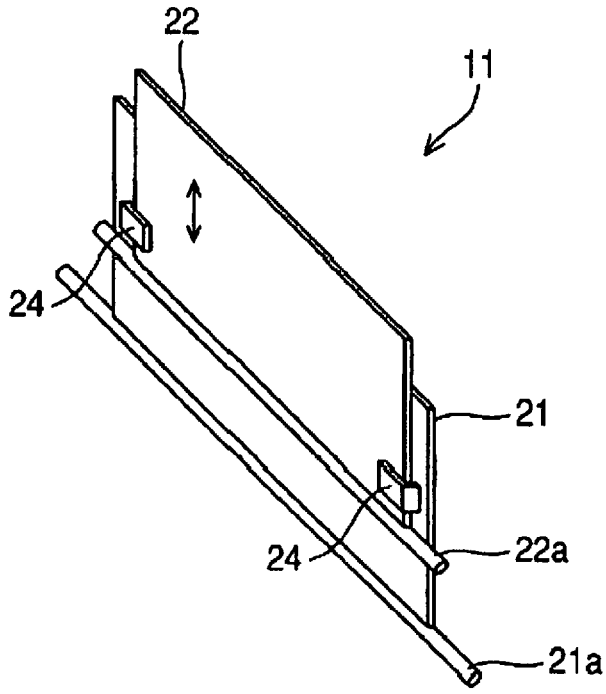
FIG. 5 is an exterior view of the agitating member according to the first embodiment.

In FIGS. 3 to 5, reference numerals 24 represent slide guides which are L-shaped members respectively attached to either longitudinal end of first agitating plate 21 (see FIG. 5). Both longitudinal ends of second agitating plate 22 are placed inside of L-shape slide guide 24 respectively such that slide guides 24 guide the sliding movement of second agitating plate 22 in a radial direction of rotation of first agitating plate 21.

As shown in FIG. 3, side plates 20*a* of case 20 in this embodiment rotatably support rotation shaft 7*a* of developing roller 7, rotation shaft 9*a* of feed roller 9, and rotation shaft 21*a* of first agitating member 11, which serves as a rotation shaft (axis) of agitating member 11. Sealing members (not shown) made of felt or the like are provided at bearings (or rotary support portions) for the respective rotation shafts, to prevent toner T from leaking to the outside.

Insides of both side plates 20*a* of case 20, guide plates 26 are integrally attached. Each guide plate 26 has elliptical guide groove 25 (see FIG. 6) which guides both axial ends of guide shaft 22*a* such that the path of the tip of second agitating plate 22 is elliptical.

Note that guide grooves 25 may be directly formed on side plates 20*a* of case 20.

Rotation shaft 21*a*, serving as the rotation shaft of agitating member 11 of this embodiment, is placed outside of area AR and in the opposite side of nip 18 (see FIG. 2). This configuration achieves agitation of toner T in a wide agitation area including area AR.

Next, the operation of the above configuration will be described.

Above described photosensitive drum 5, charging roller 6, exposure head 13, developing roller 7, feed roller 9, agitating member 11, transfer roller 14, driving roller 3*a*, and fixing device 15 are controlled by a control unit (not shown).

The control unit applies high DC voltages from a power source (not shown) to charging roller 6, transfer roller 14, developing roller 7, development blade 8, and feed roller 9 at a predetermined time and rotates driving roller 3*a*, photosensitive drum 5, charging roller 6, developing roller 7, feed roller 9, agitating member 11, and fixing device 15 by a drive source such as a motor (not shown).

In the process of printing onto sheet P by image forming device 1 of this embodiment, the control unit waits for reception of a print instruction from a host apparatus or an external apparatus (not shown) such as a personal computer. When a print instruction is received, the control unit drives photosensitive drum 5 in the rotation direction (see FIG. 1) at a predetermined circumferential speed and applies DC voltage to charging roller 6 rotating with photosensitive drum 5, thereby uniformly charging the surface of photosensitive drum 5.

According to the embodiment, when a DC voltage of −1050 V is applied to charging roller 6, the charge potential on the surface of photosensitive drum 5 is about −550 V.

The control unit transmits an emission command to exposure head 13, and then exposure head 13 emits light corresponding to an image signal to photosensitive drum 5 to form an electrostatic latent image on photosensitive drum 5.

Further, the control unit rotates feed roller 9 to which the voltage is applied to supply toner T fed into developing device 19 to developing roller 7, and rotates developing roller 7 in an opposite direction to the rotation of photosensitive drum 5 to convey toner T that is adhered to developing roller 7 toward development blade 8 disposed downstream of the rotation direction. The control unit further applies a DC voltage of −330 V to development blade 8 which is pressed against developing roller 7, to form a toner layer of toner T on developing roller 7.

According to this embodiment, a DC voltage of −330 V is applied to feed roller 9 and the circumferential speed of feed roller 9, which rotates in the same direction as developing roller 7, is set to be 0.6 times faster than the circumferential speed of developing roller 7. Further, the contact pressure between development blade 8 and developing roller 7 is set to be about 0.8 (N/cm).

Corresponding to the timing of driving developing roller 7 to rotate, the control unit rotates agitating member 11 about rotation shaft 21*a* of first agitating plate 21 in the same direction as the rotation of developing roller 7.

Here, as shown in FIG. 6, according to the rotation movement of first agitating plate 21, guide shaft 22*a* both of whose ends are engaged with guide grooves 25 moves along guide groove 25. In respective rotation positions in the rotation movement, second agitating plate 22 guided by slide guide 24 reciprocates in the radius direction on first agitating plate 21. That is, the tip of second agitating plate 22 moves along the elliptical path indicated by the dotted line in FIG. 6, while agitating toner T that exists in the wide agitating area including area AR (see FIG. 2).

In this case, toner T may enter a gap between guide groove 25 and guide shaft 22*a*, a gap between second agitating plate 22 and first agitating plate 21, and a gap between second agitating plate 22 and slide guide 24; however, toner T of this embodiment including the additive that enhances the flowability is smooth and the particle size of toner T is extremely smaller than each gap, so that the movement of second agitating plate 22 is not disturbed.

On the other hand, the control unit rotates developing roller 7 to transfer a layer of toner T that passed through development blade 8 to photosensitive drum 5, thereby developing an electrostatic latent image on photosensitive drum 5 with toner T.

Note that, since the development is a reversal development, bias voltage is applied between the conductive support member of photosensitive drum 5 and developing roller 7 and DC voltage of −200 V is applied to developing roller 7. Further, an electric field caused by the electrostatic latent image on photosensitive drum 5 exists between developing roller 7 and photosensitive drum 5, so that charged toner T on developing roller 7 is attracted to and adhered on photosensitive drum 5 by the electrostatic force thereby developing the electrostatic latent image to form the toner image on photosensitive drum 5.

Then, when sheet P fed from a sheet cassette (not shown) is transferred to image forming device 1 by transfer belt 3, the control unit applies voltage to transfer roller 14 provided opposed to photosensitive drum 5 to transfer the toner image from the photosensitive drum 5 to sheet P.

After the transfer of the toner image, some toner T may remain on photosensitive drum 5; however, such remaining toner is removed by cleaning blade 10 and photosensitive drum 5 is repeatedly used.

After the transfer of the toner image to sheet P, the control unit controls transfer belt 3 to convey sheet P to fixing device 15, and fixing device 15 to fix the toner image on sheet P, and further transfers sheet P having the fixed toner image thereon to discharge it outside the printer.

In order to confirm the effects of developing device 19 having agitating member 11 that defines the elliptical path with above described first and second agitating plates 21, 22, continuous printing tests at various printing speeds are implemented and fading occurrence conditions are compared with the cases of another developing device having an agitating member that defines a circular path. The evaluation results are shown in FIG. 7.

The comparison evaluations are performed based on whether or not fading appears on a printed image on sheet P when 100%-duty solid printing is executed in each color after executing continuous 0%-duty blank printing on a predetermined number of A4-size sheets. The prints for the comparison evaluations are executed at printing speeds of 100 mm/s, 150 mm/s, and 200 mm/s.

Note that, in the fading evaluations, "-" represents a case that fading is found in the image and "✓" represents a case that fading is not found. Further, the number of sheets in the blank printing are set as 0, 2500, 5000, 7500, 10000, 12500 and 15000.

As shown in FIG. 7, in the developing device that defines a circular path, it is found that fading occurs when the printing speed is high and the number of sheets in continuous printing increases. In other words, in the developing device that defines the circular path, fading does not occur in 15000-sheet printing at printing speed of 100 mm/s, fading occurs in 10000-sheet printing at printing speed of 150 mm/s, and fading occurs in 5000-sheet printing at printing speed of 200 mm/s. On the other hand, in developing device 19 of this embodiment, fading does not occur even in 15000-sheet printing at printing speed of 200 mm/s.

This comparison result shows that, since the agitating member 11 composed of the two agitating plates (first and second agitating plates 21 and 22) performs agitation of toner in a wide area, the agitating member 11 of this embodiment loosens clumped toner T in area AR above nip 18, where the agitating member that defines a circular path cannot sufficiently agitate the toner, thereby making clumped toner T flowable. This realizes a preferable image quality without fading in a long period of time even in high-speed printing.

Figure 8:
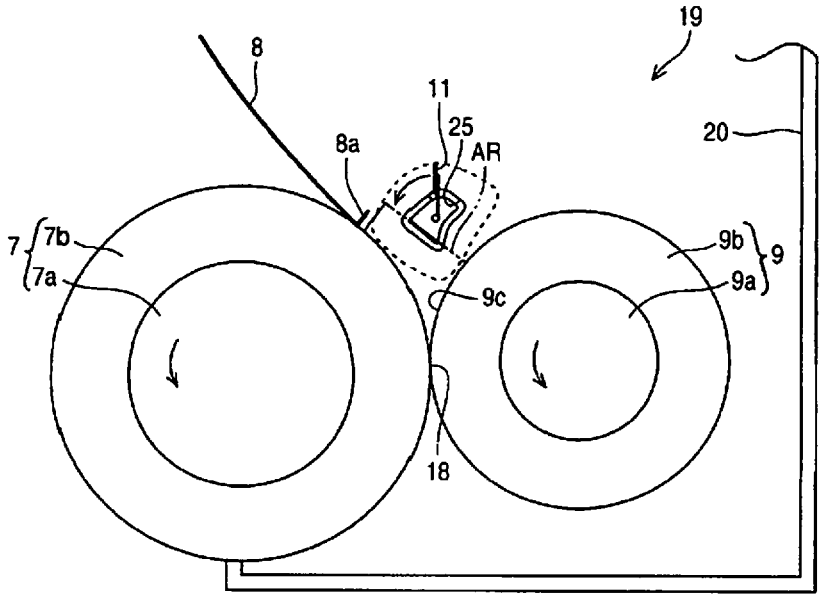
FIG. 8 is a side view of a developing device according to another example of the first embodiment.
Figure 9:
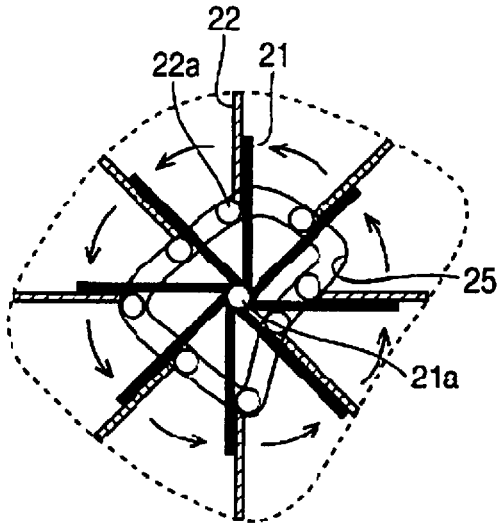
FIG. 9 illustrates positions where an agitating member of the developing device shown in FIG. 8 moved.

The tip of agitating member 11 of this embodiment moves in an elliptic path; however, as shown in FIGS. 8 and 9, a wider agitation area can be obtained when the shape of guide groove 25 is changed so that the tip of agitating member 11 moves in a rectangular loop path.

In this case shown in FIGS. 8 and 9, the rectangular loop path, serving as a noncircular path, of the tip of agitating member 11 also approaches developing roller 7, development blade 8 and feed roller 9 without contacting thereto, so that toner T in a wider agitating area including area AR above nip 18 can be agitated.

As described above, in this embodiment, the agitating member having the first and second agitating plates is provided above the contact (the nip) between the developing roller and the feed roller of the developing device, the second agitating plate is attached to the first agitating plat to be slidable in a radial direction of rotation of the first agitating plate, the guide grooves formed in the side plates of the case, and the guide shaft is provided to the second agitating plate and is to be engaged with the guide grooves. When the first agitating plate rotates, the guide shaft is moved along the guide groove while the second agitating plate moves in the radial direction of rotation of the first agitating plate, so that the path of the tip of the second agitating plate is an elliptical path whose long axis is oriented toward the nip. With this configuration, the agitating member agitates toner in a wide area including area AR above the nip. This prevents the occurrence of fading in a continuous printing and thus achieves a preferable image quality in a long period of time.

[Second Embodiment]

The developing device of this embodiment will be described with reference to FIGS. 10 to 12.

Note that, the same components as those of the first embodiment are denoted by the same reference numerals, and thus description thereof is omitted.

Figure 10:
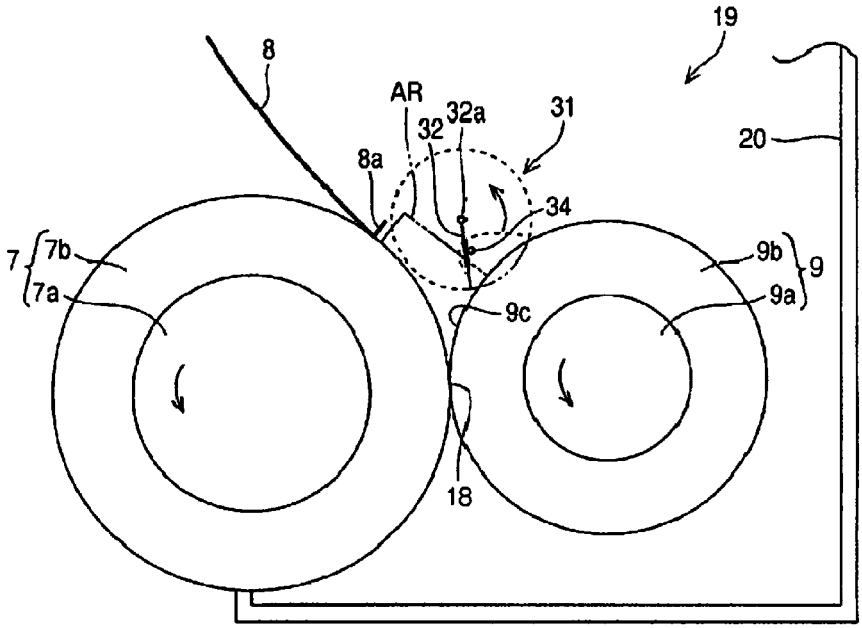
FIG. 10 is a side view of a developing device according to a second embodiment.

As shown in FIG. 10, in developing device 19 of this embodiment, agitating member 31 is disposed at the same place as agitating member 11 of the first embodiment. Agitating member 31 includes agitation film 32, rotation shaft 32*a* for driving agitation film 32 to rotate, and contact bar 34 for deforming a rotation path of the end of agitation film 32.

Agitation film 32 is a rectangular member, which is made of an elastic PET (Polyethylene Terephthalate) film having a thickness of 0.125 mm and a longitudinal length substantially the same as the axial lengths of developing roller 7 and feed roller 9. One of the widthwise ends of agitation film 32 is attached to rotation shaft 32*a* such that agitation film 32 is driven to rotate about rotation shaft 32*a* in the same direction as the rotation of developing roller 7 and feed roller 9.

Figure 11:
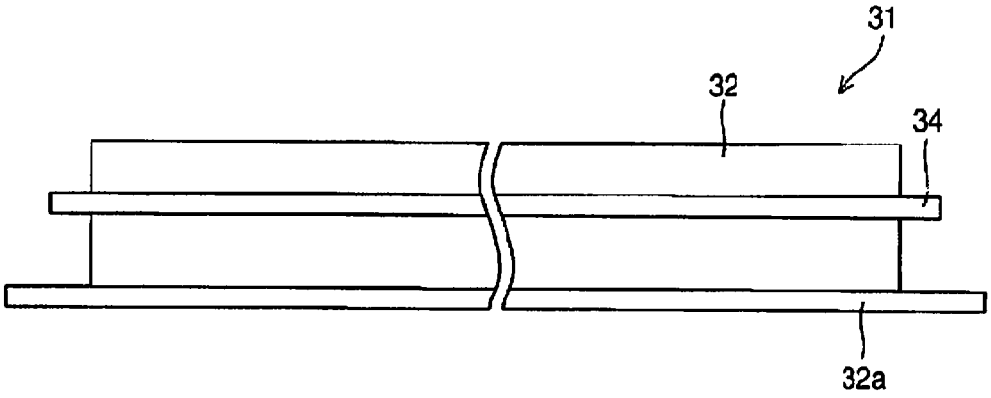
FIG. 11 is a front view of an agitating member according to the second embodiment.

As shown in FIG. 11, contact bar 34 is a metal rod member having an outside diameter of 1 mm and a longitudinal length longer than the axial lengths of developing roller 7 and feed roller 9. Contact bar 34 is disposed between rotation shaft 32*a* and the outer circumferential surface of feed roller 9, having both ends fixed to side plates 20*a* of case 20. Contact bar 34 has a function to guide the tip of agitation film 32 along a noncircular path that is basically circular but has a concave portion on the side of feed roller 9 as indicated by the dotted line in FIG. 10. The concave portion on the side of feed roller 9 prevents the tip of agitation film 32 from contacting with the outer circumferential surface of feed roller 9.

With such a configuration, the tip of agitating member 31 moves along a path, the noncircular path having the concave portion on the side of feed roller 9, which approaches close to but does not contact with developing roller 7, development blade 8 and feed roller 9 so that toner T can be agitated in a wider agitation area including area AR above nip 18.

Operation of the above configuration will be explained.

Agitating member 31 of this embodiment is controlled and driven by a control unit (not shown) at a predetermined time.

The operations from the reception of the print instruction by the control unit to the formation of the thin layer of toner T on developing roller 7 by development blade 8 is the same as those of the first embodiment, so the explanation will be omitted.

Corresponding to the time of driving developing roller 7 to rotate, the control unit rotates agitating member 31 about rotation shaft 32*a* of agitation film 32 in the same direction as the rotation of developing roller 7.

Here, upon rotation of agitation film 32, the tip of agitation film 32 moves in the noncircular path indicated by the dotted line of FIG. 10. When the tip of agitation film 32 moves closer to the outer circumferential surface of feed roller 9, agitation film 32 comes in contact with contact bar 34 provided near the outer circumferential surface of feed roller 9 (see FIG. 11) and is thus bent due to its elasticity. When the tip of agitation film 32 slides over contact bar 34, agitation film 32 regains the original flat shape due to its elasticity so that the tip of agitation film 32 rotates along the noncircular path that is basically circular but has the concave portion on the side of feed roller 9. With this rotation of agitating film 32, toner T is agitated in the wide agitation area including area AR above nip 18 (see FIG. 10).

The subsequent operations such as the formation of the toner image and the transfer and fix of the toner image onto sheet P are the same as those in the first embodiment, so the explanations are omitted.

In order to confirm the effects of developing device 19 having agitating member 31 with agitation film 32 moving in the noncircular path having the concave portion on the side of feed roller 9, continuous printing tests the same as the first embodiment were implemented. The evaluation results are shown in FIG. 12.

The condition of the comparison evaluation and fading evaluation are the same as those of the first embodiment.

Figures 12, 13:
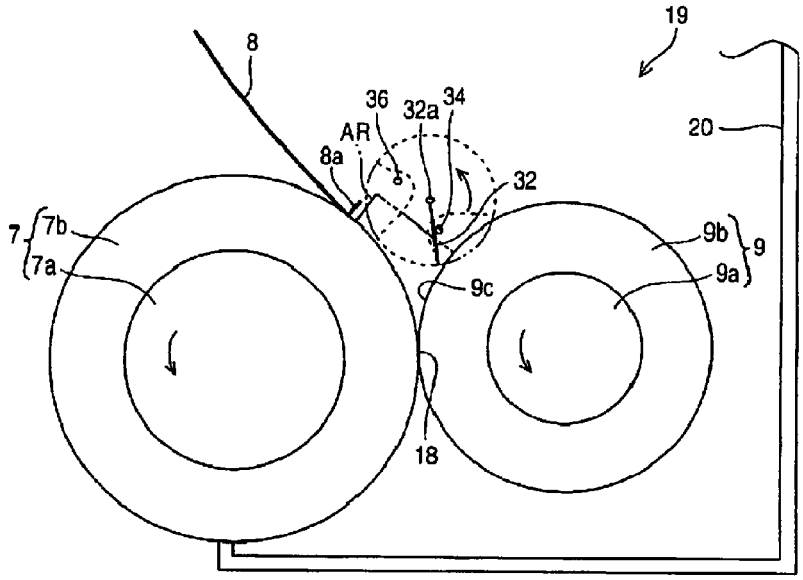
FIG. 12 illustrates test results of a continuous printing test of the developing device according to the second embodiment.
FIG. 13 is a side view of a developing device according to another example of the second embodiment.

As shown in FIG. 12, in the developing device that defines the circular path, as the printing speed increases, fading occurred when the number of printing sheets increased. In other words, in the developing device that defines a circular path, fading did not occur in a 15000-sheet printing at the printing speed of 100 mm/s; however, fading occurred in a 10000-sheet printing at the printing speed of 150 mm/s and fading occurred in a 5000-sheet printing at the printing speed of 200 mm/s. On the other hand, in developing device 19 of this embodiment, fading did not occur in a 15000-sheet printing even at the printing speed of 200 mm/s.

As described above, agitating member 31 is composed of agitation film 32 and contact bar 34 and agitation film 32 contacts with contact bar 34 to deform the rotation trajectory of the tip of agitating film 32 into a circular path having a concave portion in the side of feed roller 9 to agitate a wide area. This loosens the clumping of toner T in area AR above nip 18, which cannot be sufficiently agitated by the agitating member having a circular path, and results in preferable image quality without fading in a long period of time even in a high-speed printing speed.

In this embodiment, contact bar 34 is disposed between rotation shaft 32*a* and the outer circumferential surface of feed roller 9; however, as shown in FIG. 13, second contact bar 36 may be additionally disposed between rotation shaft 32*a* and the outer circumferential surface of developing roller 7, such that the agitation film rotates while contacting with second contact bar 36 and first contact bar 34 and the tip of agitation file thus moves along a noncircular path having a concave portion on the side of developing roller 7 in addition to the concave portion on the side of feed roller 9 as indicated by the dotted line in FIG. 13.

In this case shown in FIG. 13, the tip of agitating member 31 moves along a path, which is a noncircular path having the concave portions on the side of developing roller 7 and on the side of feed roller 9, approaching close to but not contacting with developing roller 7, development blade 8, and feed roller 9 so that toner T is agitated in a wide agitating area including area AR above nip 18.

As described above, according to the second embodiment, agitating member 31 is composed of agitation film 32 and contact bar 34 and, when agitation film 32 rotates, agitation film 32 contacts with contact bar 34, and the tip of agitation film 32 moves in the noncircular path having the concave portion on the side of feed roller 9 or the concave portions on the side of developing roller 7 and feed roller 9, so that the same effects as the first embodiment can be obtained.

Note that the above respective embodiments of the invention are applied to an electrophotographic color printer; however, the invention may also be applied to an electrophotographic monochrome developing device and image forming apparatus such as a monochrome printer, copier, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developing device comprising:

a developer carrier configured to form a developer image on an image carrier by developing an electrostatic latent image on the image carrier;

a developer supplier configured to supply a developer to an outer circumferential surface of the developer carrier while being in contact with the outer circumferential surface of the developer carrier;

a developer layer regulating member configured to form a layer of the developer on the outer circumferential surface of the developer carrier;

an agitating member configured to agitate the developer in a vicinity of the developer carrier or the developer supplier; and a case having a support portion configured to rotatably support the developer carrier, the developer supplier, and the agitating member, wherein a rotational center of the agitating member is provided above a contact between the developer carrier and the developer supplier, and wherein a rotation path of a tip of the agitating member upon a rotation of the agitating member is a noncircular path having a long axis that extends toward the contact between the developer carrier and the developer supplier, the noncircular path having a short axis that extends in a direction substantially parallel to a direction along which the developer carrier and the developer supplier are arranged.

2. The developing device according to claim 1, wherein the agitating member comprises:

a first agitating plate attached to a rotation shaft rotatably supported by the support portion; and a second agitating plate attached to the first agitating plate to be slidable in a radial direction of rotation of the first agitating plate, and wherein, a tip of the second agitating plate, which is the tip of the agitating member, moves in the radial direction of the rotation of the first agitating plate upon the rotation of the first agitating member and thus the tip of the second agitating plate moves in the noncircular path.

3. The developing device according to claim 2, further comprising:

a noncircular first guide provided at the case;

a second guide provided at the second agitating plate and engaged with the first guide; and a slide guide provided at the first agitating plate and configured to guide the second agitating plate to be slidable, wherein, upon the rotation of the first agitating plate, the second guide moves along the first guide while the second agitating plate moves in the radial direction of the rotation of the first agitating plate and thus the tip of the second agitating plate moves in the noncircular path.

4. The developing device according to claim 1, wherein the support portion is a side plate of the case.

5. The developing device according to claim 1, wherein the noncircular path is an elliptical path having the long axis extending toward the contact between the developer carrier and the developer supplier.

6. An image forming apparatus comprising the developing device according to claim 1.

7. An image forming apparatus comprising:

an image carrier;

an exposing device configured to form an electrostatic latent image on the image carrier;

the developing device according to claim 1 configured to form the developer image on the image carrier by developing the electrostatic latent image on the image carrier;

a transfer unit configured to transfer the developer image on the image carrier to a medium; and a fixing unit configured to fix the developer image that was transferred on the medium onto the medium.

8. A developing device comprising:

a developer carrier configured to form a developer image on an image carrier by developing an electrostatic latent image on the image carrier;

a developer supplier configured to supply a developer to an outer circumferential surface of the developer carrier while being in contact with the outer circumferential of the developer carrier;

a developer layer regulating member configured to form a layer of the developer on the outer circumferential surface of the developer carrier;

an agitating member configured to agitate the developer in a vicinity of the developer carrier or the developer supplier;

a case having a support portion configured to rotatably support the developer carrier., the developer supplier, and the agitating member;

a noncircular first guide provided at the case;

a second guide provided at the second agitating plate and engaged with the first guide; and a slide guide provided at the first agitating plate and configured to guide the second agitating plate to be slidable, wherein the agitating member comprises:

a first agitating plate attached to a rotation shaft rotatably supported by the support portion; and a second agitating plate attached to the first agitating plate to be slidable in a radial direction of rotation of the first agitating plate, and wherein a rotation path of a tip of the agitating member upon a rotation of the agitating member is noncircular, wherein, a tip of the second agitating plate, which is the tip of the agitating member, moves in the radial direction of the rotation of the first agitating plate upon the rotation of the first agitating member and thus the tip of the second agitating plate moves in the noncircular path, wherein, upon the rotation of the first agitating plate, the second guide moves along the first guide while the second agitating plate moves in the radial direction of the rotation of the first agitating plate and thus the tip of the second agitating plate moves in the noncircular path, wherein the first guide is a guide groove formed at the case, and wherein the second guide is a guide shaft formed at the second agitating plate and fit in the guide groove to be slidable along the guide groove.

9. The developing device according to claim 8, wherein the support portion is a side plate of the case.

10. The developing device according to claim 8, wherein the noncircular path is an elliptical path having a long axis toward a contact between the developer carrier and the developer supplier.

11. A developing device comprising:

a developer carrier configured to form a developer image on an image carrier by developing an electrostatic latent image on the image carrier;

a developer supplier configured to supply a developer to an outer circumferential surface of the developer carrier while being in contact with the outer circumferential of the developer carrier;

a developer layer regulating member configured to form a layer of the developer on the outer circumferential surface of the developer carrier;

an agitating member configured to agitate the developer in a vicinity of the developer carrier or the developer supplier;

a case having a support portion configured to rotatably support the developer carrier, the developer supplier, and the agitating member;

wherein rotation path of a tip of the agitating member upon a rotation of the agitating member is noncircular, wherein the agitating member comprises:

a flexible agitation film attached to a rotation shaft rotatably supported by the support portion; and a contact bar provided inside a circular locus of a tip of the agitation film about the rotation shaft, and wherein, upon the rotation of the agitation film, the tip of the agitation film, which is the tip of the agitating member, moves in the noncircular path as the agitation film comes in contact with the contact bar.

12. The developing device according to claim 11, wherein the contact bar is provided between the rotation shaft of the agitation film and an outer circumferential surface of the developer supplier.

13. The developing device according to claim 11, wherein the contact bar includes two bars, one of which is provided between the rotation shaft of the agitation film and an outer circumferential surface of the developer supplier and the other of which is provided between the rotation shaft of the agitation film and the outer circumferential surface of the developer carrier.

14. A developing device used for supplying a developer, comprising a first roller being rotatable;

a second roller being rotatable while being in contact with the first roller;

an agitating member configured to rotate about a rotational axis to agitate the developer in the vicinity of the contact between the first roller and second roller, wherein a rotational center of the agitating member is provided above a contact between a developer carrier and a developer supplier, and wherein a rotation path of a tip of the agitating member upon a rotation of the agitating member is a noncircular path having a long axis that extends toward the contact between the developer carrier and the developer supplier, the noncircular path having a short axis that extends in a direction substantially parallel to a direction along which the developer carrier and the developer supplier are arranged.

15. The developing device according to claim 14, further comprising:

a case having a support portion configured to rotatably support the developer carrier, the developer supplier, and the agitating member, wherein the support portion is a side plate of the case.

16. The developing device according to claim 15, wherein the agitating member comprises:

a flexible agitation film attached to a rotation shaft rotatably supported by the support portion; and a contact bar provided inside a circular locus of a tip of the agitation film about the rotation shaft, and wherein, upon the rotation of the agitation film, the tip of the agitation film, which is the tip of the agitating member, moves in the noncircular path as the agitation film comes in contact with the contact bar.

17. The developing device according to claim 16, wherein the contact bar is provided between the rotation shaft of the agitation film and an outer circumferential surface of the developer supplier.

18. The developing device according to claim 16, wherein the contact bar includes two bars, one of which is provided between the rotation shaft of the agitation film and an outer circumferential surface of the developer supplier and the other of which is provided between the rotation shaft of the agitation film and the outer circumferential surface of the developer carrier.

19. A developing device comprising:

a cylindrical developer carrier configured to form a developer image on an image carrier by developing an electrostatic latent image on the image carrier;

a cylindrical developer supplier configured to supply a developer to an outer circumferential surface of the developer carrier while being in contact with the outer circumferential of the developer carrier;

a developer layer regulating member configured to form a layer of the developer on the outer circumferential surface of the developer carrier;

an agitating member configured to agitate the developer in a vicinity of the developer carrier or the developer supplier; and a case having a support portion configured to rotatably support the developer carrier, the developer supplier, and the agitating member, wherein a rotation path of a tip of the agitating member upon a rotation of the agitating member is noncircular such that the tip of the agitating member passes through an area defined by the developer carrier circumference and the cylindrical developer supplier circumference and a true circle that is tangent to both of the developer carrier circumference and the cylindrical developer supplier circumference, wherein the center of the true circle is the rotational center of the agitating member.

* * * * *